United States Patent [19]

England, III et al.

[11] 3,976,004

[45] Aug. 24, 1976

[54] APPARATUS FOR METAL RULE DIE EMBOSSING AND STAINING

[76] Inventors: John W. England, III, 1101 Mountain Road - Apt. 8; Jeffery E. Wright, Plantation East - Apt. 3, both of Martinsville, Va. 24112

[22] Filed: May 30, 1974

[21] Appl. No.: 474,310

Related U.S. Application Data

[63] Continuation of Ser. No. 317,812, Dec. 22, 1972, abandoned.

[52] U.S. Cl. ..... 101/26; 101/30; 101/115; 101/129; 101/366

[51] Int. Cl.[2] ..... B44B 5/02; B41F 31/08

[58] Field of Search ..... 101/114, 115, 129, 366, 101/30, 26

[56] References Cited

UNITED STATES PATENTS

| | | | |
|---|---|---|---|
| 319,417 | 6/1885 | Keieg | 101/27 |
| 659,535 | 10/1900 | Lankford | 101/114 |
| 1,275,256 | 8/1918 | Hoe | 101/366 |
| 1,283,899 | 11/1918 | Reis et al. | 101/30 |
| 1,890,192 | 12/1932 | Pfeiffer | 101/114 |
| 3,009,415 | 11/1961 | Harvey | 101/28 |
| 3,056,384 | 10/1962 | Beale et al. | 101/115 |
| 3,154,010 | 10/1964 | Rudy | 101/3 SP |
| 3,279,368 | 10/1966 | Wilson | 101/269 |
| 3,543,682 | 12/1970 | Farrow | 101/366 |
| R10,686 | 2/1886 | Compton | 101/30 |

*Primary Examiner*—Clyde I. Coughenour
*Attorney, Agent, or Firm*—Jack N. McCarthy

[57] ABSTRACT

A die member is formed having a desired configuration formed thereon by a metal rule. Absorbent means are placed within said metal rule for receiving a stain. Press means are provided to press the metal rule into a stock-piece to emboss the design therein and stain it with the stain contained by the absorbent means. The stain may be applied manually or by an automatic system. The press means can be a conventional press or other types which will provide the desired action. One other arrangement uses a cylindrical roller having a cylindrical die member thereon which can roll over a stock-piece to provide the same result.

4 Claims, 6 Drawing Figures

APPARATUS FOR METAL RULE DIE EMBOSSING AND STAINING

This is a continuation of application Ser. No. 317,812, filed Dec. 22, 1972, now abandoned.

BACKGROUND OF THE INVENTION

The review of prior art indicates that previously wood grain printing was done which involved using a raised surface having a coloring on the raised surface. Further, previously, wood was first embossed and then carefully hand stained within the embossed area.

SUMMARY OF THE INVENTION

An object of this invention is to emboss and stain stockpieces in one operation.

Another object of the invention is to provide a die member having a metal rule of a desired configuration with an absorbent means within said metal rule means for containing a stain.

A further object of the device is to provide means for automatically delivering stain to said absorbent means.

A further object of the invention is to provide a method wherein a design is cut to a desired depth in a stock-piece and absorbent means, containing stain, stains the stock-piece within the area enclosed by the metal rule die.

DESCRIPTION OF THE PREFERRED EMBODIMENT

Figure 1:
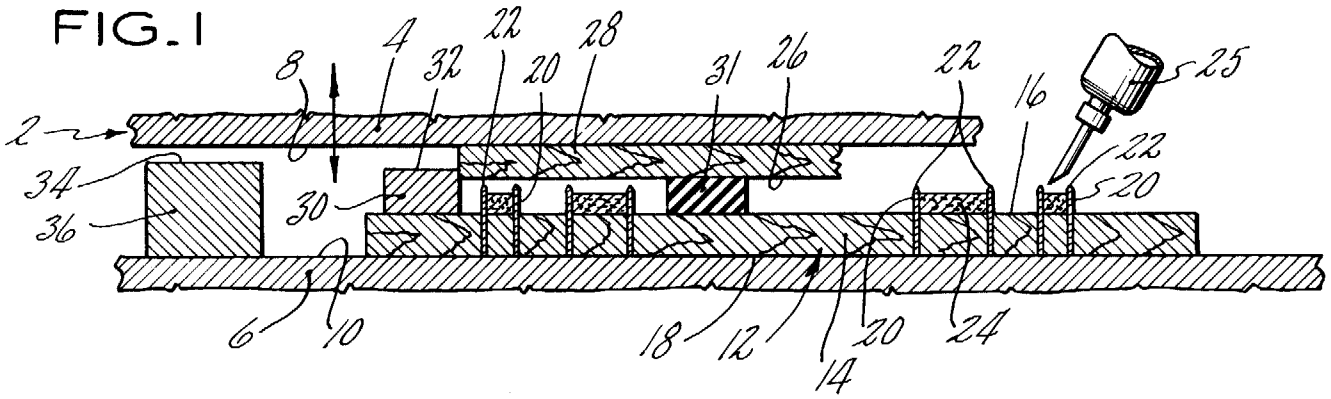
FIG. 1 is a schematic view showing a press incorporating the invention wherein manual stain application is used.

FIG. 1 shows a schematic view of a press 2 having members 4 and 6 which are mounted for in-line relative movement towards or away from each other. Either member can be fixed, with the remaining member being provided with power means for providing the force necessary to move it towards the other member to perform the required work. It is also possible that both members can be provided with power means for moving them relatively to each other. Member 4 has a flat surface 8 which faces a flat surface 10 on member 6.

The member 6 has a die member 12 located thereon. The die member 12 comprises a plate-like member 14 having opposite parallel surfaces 16 and 18. The die member 12 is positioned and fixed with its surface 18 engaging the surface 10 of the member 6. Die member 12 can also be fixed to surface 8 of member 4. This die member can be fixed by any means desired, if necessary, such as by bolts. Die member 12 may be prepared for use and moved just prior to press actuation from a position outside of the press means 2 into said press means 2 between members 4 and 6.

The surface 16 has metal rule means 20 projecting therefrom. The metal rule means 20 extends perpendicular to the surface 16 of the plate-like member 14 and is shaped to form a desired configuration. The free edge 22 of the metal rule means 20 is formed as a sharp cutting edge. Absorbent means 24 is fixedly positioned within an area defined by metal rule means 20 which is desired to be stained. The absorbent means 24 does not extend to the sharp edge of the free end 22 of the metal rule means 20, but is recessed in the area within the metal rule means 20 where it is placed. A squeeze bottle 25 is shown for applying liquid stain to the absorbent means 24. If different colored stains are desired for application to the absorbent means, then a plurality of squeeze bottles 25 can be used, each having a different desired colored stain.

Figure 3:
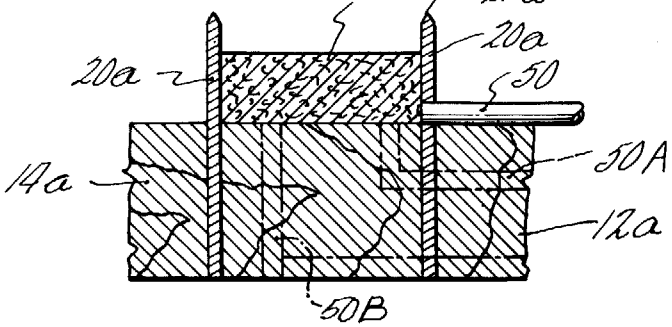
FIG. 3 is a fragmentary view of a section of a die member showing the metal rule means and different positions of stain delivering tubes.

The die member 12 can be constructed in many ways. One construction consists of thin pieces of spring steel inserted edgewise into, and supported by, a plywood board, forming the desired configuration. A rule cutting device can also be formed as set forth in U.S. Pat. No. 3,212,365 wherein a metal rule is welded to a metal backing plate. The sharp edge is usually formed as shown in FIG. 3, with an equal angular taper on each side.

The sharp edge of the free end 22 of the metal rule means 20 cuts the configuration of the metal rule means 20 into a flat surface 26 of a flat stock-piece 28 thereby embossing it when the metal rule means 20 of die member 12 is applied to the stock-piece 28 under the necessary amount of pressure, and the absorbent means 24, containing liquid stain, contacts the surface of the stock-piece between the metal rule means where it is inserted, thereby staining it. The stock-piece 28 must be capable of being cut by the sharp edge of the free end 22 of the metal rule means 20 and capable of receiving a stain.

Stock-piece locating stop means 30 are fixed to the surface 16 of the die member 12 to engage the outer edges of a flat stock-piece 28 at several locations to properly position it in the press in relation to the die member 12. While only one stock-piece locating stop means 30 is shown in FIG. 1, others are located on the die member 12 around the configuration formed by the metal rule means 20. The stock-piece locating stop means 30, while shown fixed to the surface 16 of the die member 12, can be fixed to other members of the press such as the surface 10 of the member 6.

While the stock-piece locating stop means 30 used is shown as a block, it can be made adjustable, if necessary, to accommodate a range of sizes of stock-pieces 28. The top surface 32 of each locating stop means 30 is formed below the top 34 of a press stop means 36 so as not to interfere with the closing movement of the members 4 and 6. A rubber pad 31 is placed on the surface 16 of the die member 12 to prevent the surface of the stock-piece to be embossed from contacting the sharp edge of the free end 22 of the metal rule means 20 before the stock-piece 28 has been properly positioned and the method commenced. This rubber pad 31 also aids in biasing the stock-piece from engagement with the metal rule means after embossing and staining.

The top surface 34 of the press stop means 36 is located a predetermined distance from the surface 10 of member 6, depending on the thickness of the stockpiece 28 being cut and stained, the height of the sharp cutting edge of the free end 22 of the metal rule means 20 above the surface 10, and the depth of cut desired. While the press stop means 36 used is shown as a block, it can be made adjustable to accommodate different thicknesses of stock-pieces 28, permit the use of different die members 12, or change the depth of cut desired.

As referred to above, the die member 12 may be positioned outside the press means 2 wherein a stock-piece can be placed thereon and the die member 12 and stock-piece 28 moved into said press means for engagement between members 4 and 6. In this construction the stock-piece is properly located on the die member 12 before it is moved into the press means 2.

Figure 2:
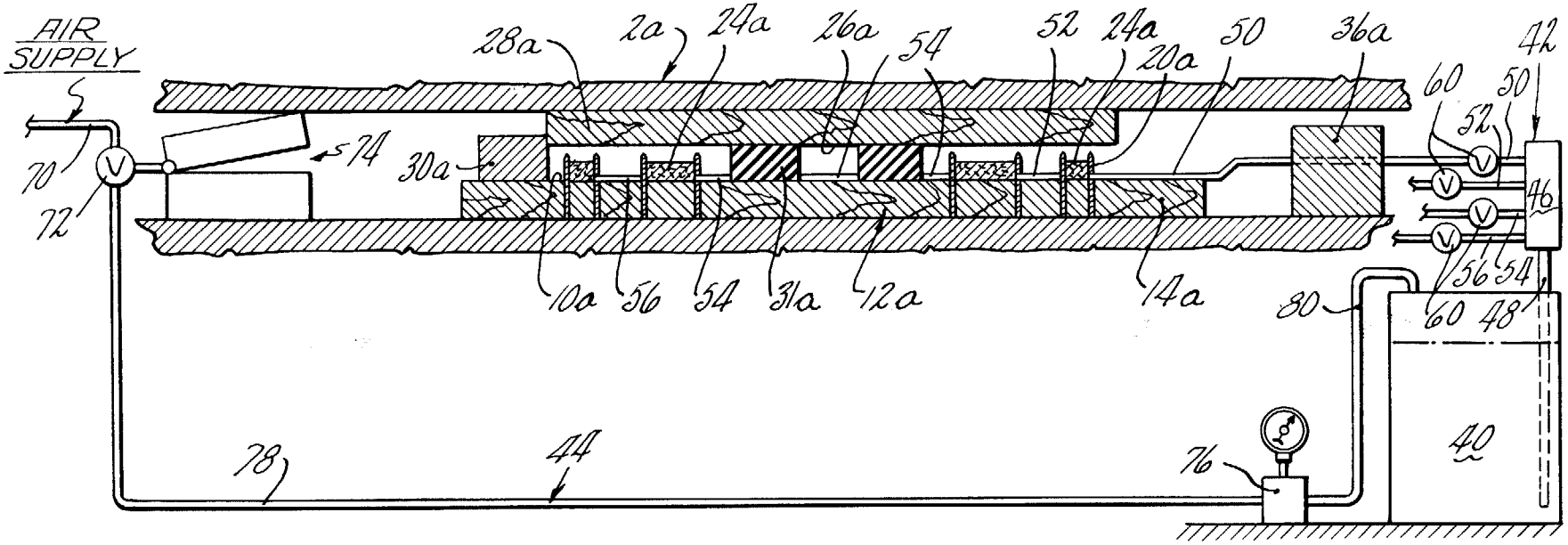
FIG. 2 is a schematic view showing a press incorporating the invention wherein automatic stain application is used.

FIG. 2 shows a schematic view of a press 2*a* which is similar to the press 2, but which further includes means for placing liquid stain in contact with absorbent means 24*a*. The means comprises a reservoir 40 containing the liquid stain along with a conduit means 42 which connects the reservoir 40 to the absorbent means 24*a* and pressure means 44 which applies a pressure to the liquid stain in a closed reservoir 40 to make it flow into the absorbent means 24*a*.

The conduit means 42 shown in FIG. 2 includes a manifold 46 with an inlet tube 48 connecting it to the interior of the reservoir at a point adjacent the bottom thereof. The manifold 46 is shown having four outlet or stain delivering tubes; 50, 52, 54 and 56, which are connected to four locations within the metal rule means 20*a* for delivering liquid stain therethrough to absorbent means 24*a* within.

While the area within the configuration on the die member 12*a* in FIG. 2 has been predetermined to use liquid stain inserted at four locations, other configurations could comprise different conduit means 42 having different numbers of outlet tubes or liquid stain delivering tubes. A simple configuration formed by a metal rule means 20 of a die member 12 could conceivably require only one conduit which could be an extension of tube 48. Valve means 60 are provided in each outlet tube adjacent the manifold 46 for precise control of flow through the outlet tubes. If one or more locations are found to receive an improper amount of liquid stain to obtain a desired effect, the valve means 60 can be adjusted to compensate for this. For example, one stain delivering tube might be found to provide an excess of liquid stain so the valve means 60 could be adjusted to restrict flow in that delivery tube. A test stock-piece can be used to check the effect being obtained before finished stock-pieces are used.

Pressure means 44, for applying a pressure to the liquid stain in the reservoir 40, includes conduit means connecting an air supply to the interior of the reservoir 40. This conduit means includes a conduit 70 leading from an air supply to an automatically actuated on-off valve 72. While this valve can be manually operated, the on-off valve 72 is shown connected to a mechanically actuated device 74 which is positioned with respect to the press 2*a*. In FIG. 2, the valve 72 is normally closed and device 74 is set to open the valve 72 at the position of the press 2*a* where the stock-piece 28*a* has been cut to the point where it has contacted the absorbent means 24*a*.

The valve 72 is connected to a pressure reducing valve 76 by a conduit 78. The pressure reducing valve 76 is connected to the interior of the reservoir 40 by a conduit 80. While the air supply can be of various pressures, it is only necessary that it be above the pressure set in the pressure reducing valve 76 which is the pressure required to properly feed the liquid stain from the reservoir 40 to the absorbent means 24*a*.

While the stain delivering tubes are shown extending along the top surface 10*a* of the die member 12*a*, they can be placed or formed within the plate-like member 14*a* as shown at 50A or extended along the grooves in the bottom of the plate-like member 14*a* as shown at 50B and extend up through the plate-like member 14*a* (see FIG. 3).

The valve 72 is operated to replace the stain used from the absorbent means 24*a*. The amount used for each operation can be figured and this amount can be returned to the absorbent means 24*a* manually or automatically. When done manually, the operator can also be watching the finished stock-piece and actuate the valve when necessary. When done automatically, the valve 72 will be open when the stain is being absorbed by the stock-piece 28*a* and closed when the stock-piece 28*a* has been withdrawn from contact with the absorbent means 24*a*.

Figure 4:
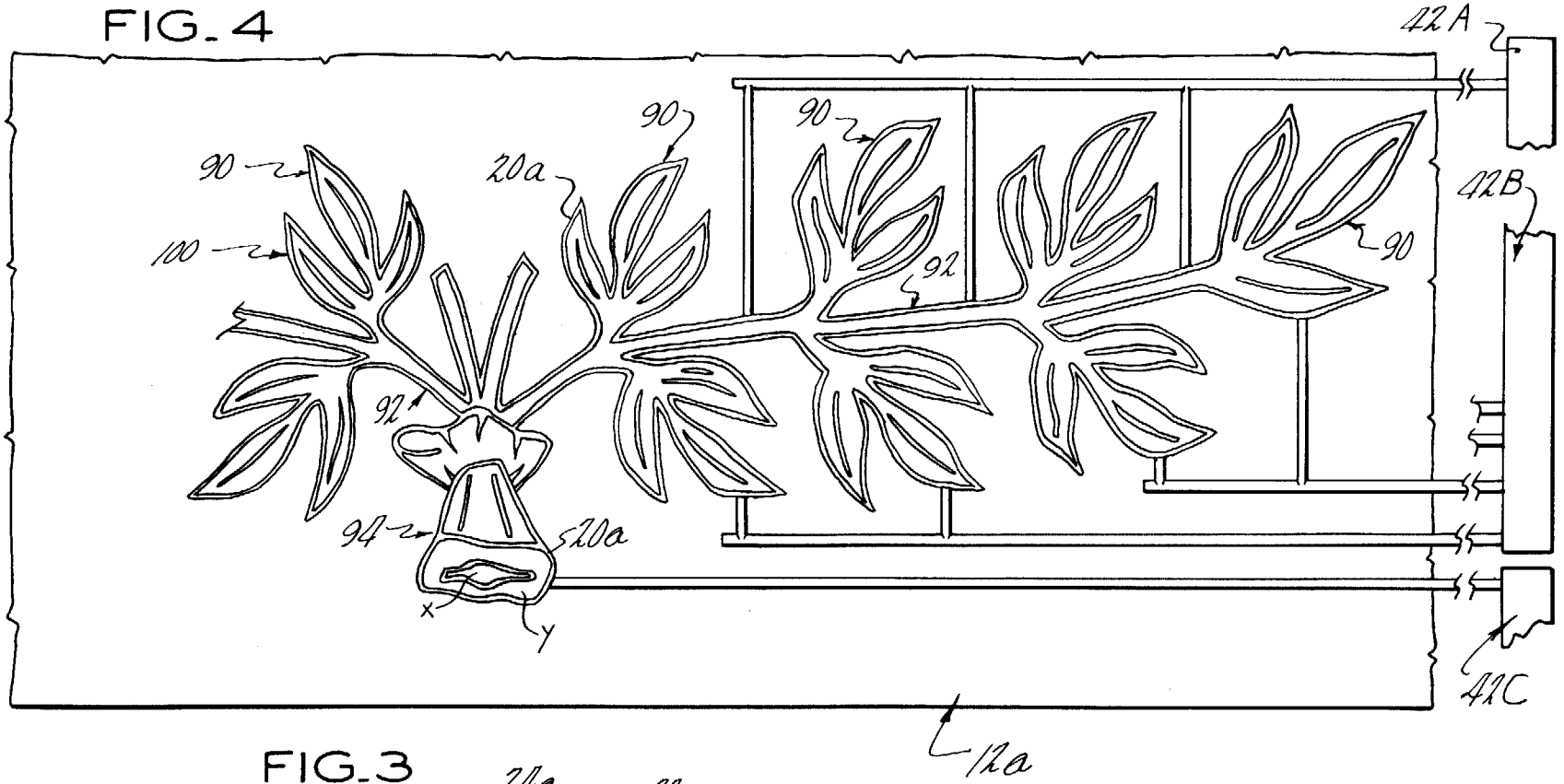
FIG. 4 is a top view of a portion of a die member showing the design formed by the metal rule means and the stain delivering tubes.

FIG. 4 schematically shows a portion of a design 100 formed by metal rule means 20*a*. This design includes leaves 90, stems 92, and a flower 94. Since it is desired to have green leaves, brown stems, and a red flower, three means for placing liquid stain in contact with the absorbent means 24*a* at different locations is necessary. To simplify the figure, the separate manifolds 42A, 42B and 42C are shown along with their stain delivering tubes. In operation, three reservoirs 40 will be needed, one for each color, and a separate conduit 80 for directing a pressure to each tank. If different pressures are needed in the tanks, then separate pressure reducing valves 76 will also be needed.

In a design where one closed area appears within another closed area, such as the areas X and Y in FIG. 4, opening or openings can be placed in the metal rule forming the smaller area to permit the stain from the larger area to pass into the small area. Further, if desired, two different colored stains can be directed into two parts of an enclosed area, permitting the blending of the stains where they meet. This blending can be controlled by a section of plain metal rule which serves only as a partition for the adjacent absorbing means but permits a blending over the top thereof; the plain metal rule being of a height which is just below the face of the stock-piece being embossed and stained when it is in its fully pressed position.

Figure 5:
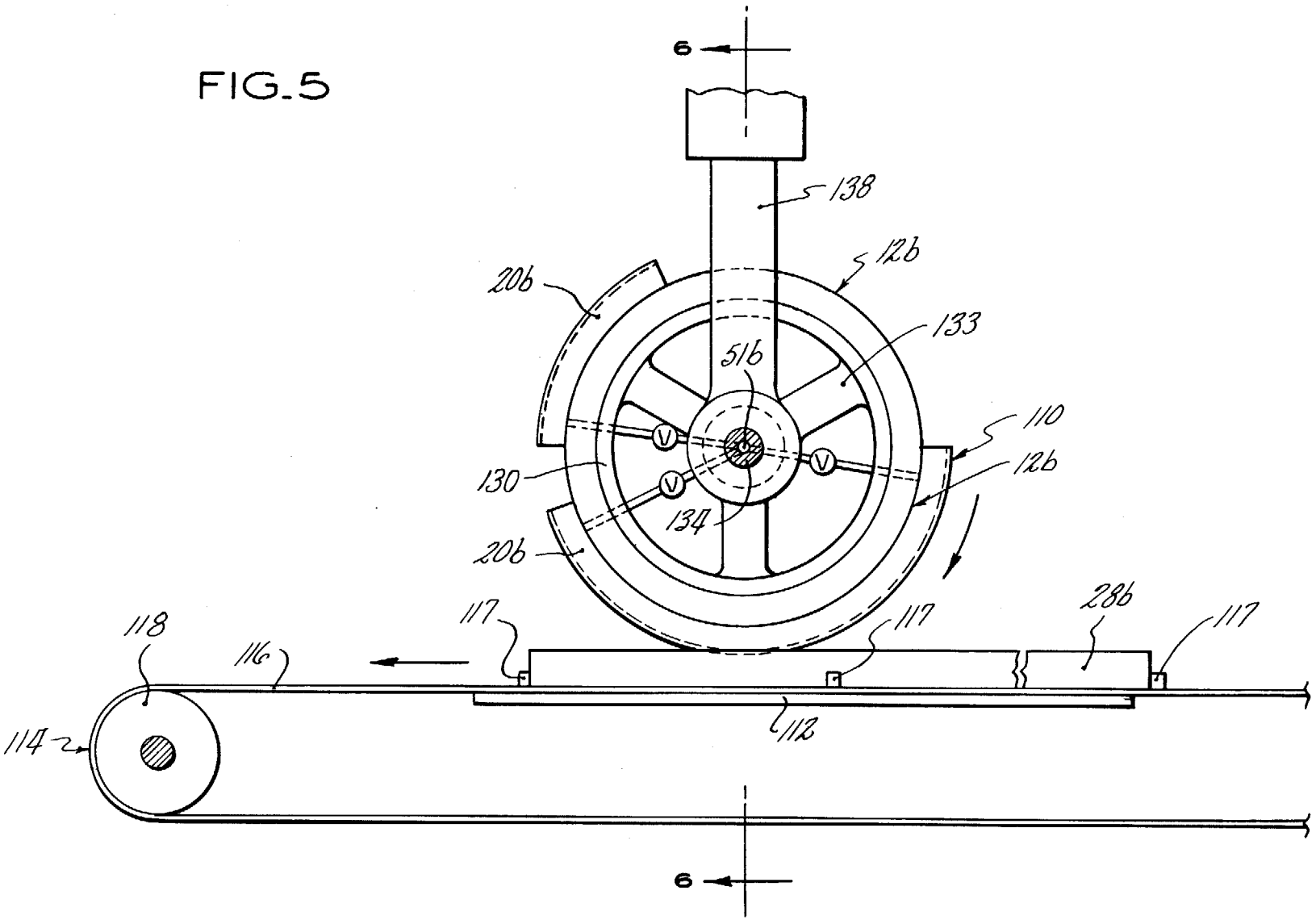
FIG. 5 is a schematic view showing a device incorporating the invention having a roller device and sliding feed wherein automatic stain application is used.
Figure 6:
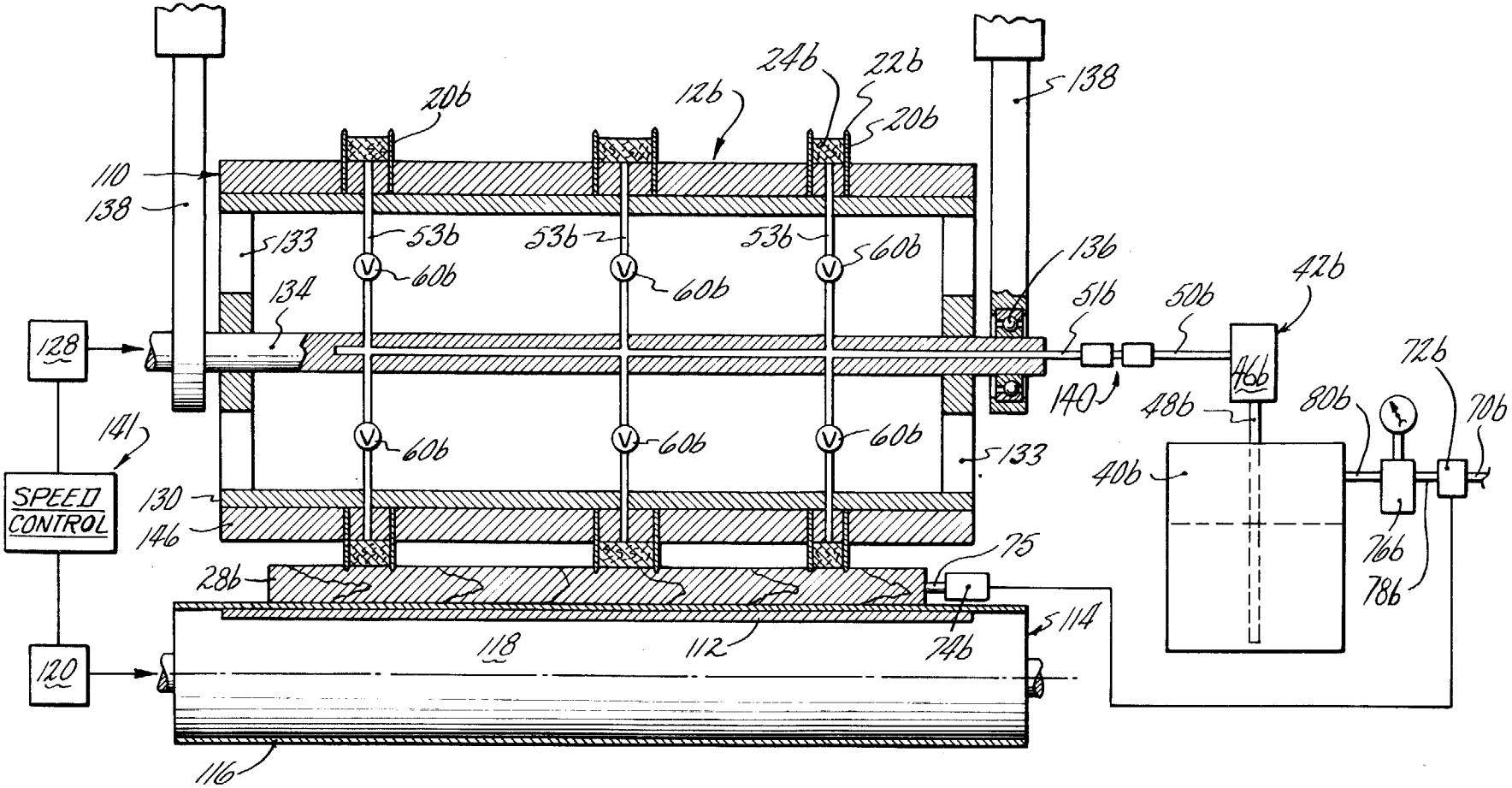
FIG. 6 is a schematic view taken along the line 6-6 of FIG. 5 showing the automatic stain system.

While the apparatus heretofore shown has been with a press having two members 4 and 6 which are mounted for in-line relative movement with respect to each other, an apparatus can be used having a roller device 110 with a cylindrical die member 12*b* thereon. As shown in FIGS. 5 and 6, a solid bed 112 is shown with a belt device 114 positioned in respect thereto to provide a sliding feed over the solid bed. The belt device 114 comprises a belt 116 which is mounted on end rollers 118, said rollers being positioned so that said belt 116 lies on the top surface of the solid bed 112. Means 120 are provided to drive the rollers 118 in a manner to be hereinafter described. While a specific belt device 114 has been shown, other sliding feeds can be used, such as a slidable flat bed on rollers to move over the solid bed. Means 117 can be provided on the face of the belt 116 to accurately position the stock-piece to properly locate the design on said stock-piece 28*b*.

The roller device 110 is formed having an inner cylinder 130 which is supported by spokes 133 fixed between the cylinder 130 and axle 134. Axle 134 extends outwardly from each end of the roller device 110 and is mounted in a bearing means 136 positioned in the free end of downwardly extending arms 138. Arms 138 can be made fixed or adjustable, any of a number of known adjustable means can be used, in accordance with the type of operation desired or the solid bed 112 and belt device 114 can be made movable in an up and down direction, by any known means.

The arms 138 are made adjustable to reposition the roller device 110 if it is necessary to alter the spacing between the belt 116 and the metal rule means **20*b* of the metal rule die member 12*b*, or as stated above, the solid bed 112 and belt device 114 could be repositioned. The provision for the changing of the spacing between the belt 116 and the metal rule means 20*b*, for example, permits removal of a stock-piece 28*b* at any time; permits changing the thickness of a stock-piece without changing the depth of cut desired; permits changing the depth of cut desired in stock-pieces of the same thickness; permits the use of a differently sized roller device 110 wherein the radius to the sharp edge 22*b* of the metal rule means 20*b* changes while still using stock-pieces of the same thickness and making the same depth of cut. Generally, the arms 138 are made adjustable, or the solid bed 112 and belt device 114 made movable, to accommodate variances in die members 12*b* and stock-pieces 28*b***.

The cylindrical die member **12*b* is made much in the same manner as the die member 12, except that the member is cylindrical. The metal rule means 20*b* must also be formed to conform to the cylindrical die member 12*b*. Absorbent means 24*b* is placed within the metal rule means 20*b*** where desired.

The means for placing liquid stain in contact with absorbent means **24*b* is similar to that set forth above and is shown in FIGS. 2 and 4. The air supply 70*b*, on-off valve 72*b*, conduit 78*b*, pressure reducing valve 76*b*, conduit 80*b*, reservoir 40*b*, tube 48*b*, manifold 42*b* and stain delivering tube 50*b* can be identical to the equipment shown in FIG. 2. In the arrangement shown with FIG. 6, the mechanically actuated device 74*b* is a micro switch having an actuating cam 75 which engages a stock-piece which will open the normally closed on-off valve 72*b* for permitting a predetermined amount of stain to be directed through stain delivering tube 50*b*. Micro switch 74*b*** can be actuated by the operator if desired.

Since it is now necesary to direct the stain from the stain delivering tube **50*b* to absorbent means 24*b* within metal rule means 20*b* on a rotating cylindrical die member 12*b*, it is necessary that a rotary joint 140 be used to connect the stationary stain delivering tube 50*b* to the stain delivering tube 51*b* which extends into the axle 134 of the roller device 110 and is rotatable with the cylindrical die member 12*b***.

The stain delivering tube **51*b* has radial extension tubes 53*b* which extend outwardly from the axle 134 and extend through the inner supporting cylinder 130 and die member 12*b* to a location within the metal rule means 20*b* containing absorbent means 24*b*. Valve means 60*b* are provided in the radial extension tubes 53*b* for the same purpose as the valve means 60. The valve means 60*b* can be actuated by access between the spokes 133.**

Means 128 are provided to drive the axle 134. The drive means 120 for driving the rollers 118 of the belt device 114 and the drive means 128 for driving the axle 134 of the roller device 110 can be any of a number of known driving means. A synchronizing speed control 141 is provided to actuate the driving means 120 and 128 so that the belt 116 moves at the same rate as the free edges **22*b* of the metal rule means 20*b* of the die member 12*b***.

Double embossing and staining can be used to put a design on both sides of a stock-piece in the same operation using, for example, the type of press shown in FIGS. 1 and 2. The die member 12 is placed on the member 6 and another die member 12 is placed on the member 4; these die members 12 being positioned to properly place the designs on two sides of a stock-piece 28. Two die members 12 may also be attached at one end to each other by means such as hinges in order that a stock-piece may be placed on one die member while the other die member is hinged over to engage the other side of the stock-piece. Both these members and the positoned stock-piece may then be inserted between the members 4 and 6 of the press means 2. Other combinations of the devices shown can be used to obtain the double embossing and staining.

In a construction built, the absorbent means 24 used was felt and it was recessed from the sharp edge 22 of the metal rule 20 by approximately 1/16 of an inch, and the metal used in the rule was steel. The valves 60 were also capable of being placed in an off position.

To emboss and stain a finished panel, the stain must contain a finish solvent to both melt the finish and carry the new stain to combine therewith to achieve the desired staining finish. For example, in a board having ink-printed wood grain thereon with a clear transparent liquid wood sealer to protect the printed grain, it would be necessary to use an acetone with wood stain.

We claim:

1. An apparatus for embossing and staining a stock-piece comprising press means; said press means having two members movable relative to each other for providing a pressing action; a metal rule die member located between said members and being positioned on one of said members; said metal rule die member having a metal rule extending therefrom towards the other of said members and forming a desired design with an enclosed area therein; said metal rule having an edge which is sharp for embossing a stockpiece; absorbent means for receiving a stain being located in the enclosed area of said metal rule; said absorbent means having an exposed surface recessed from the sharp edge of the metal rule into said enclosed area; means for placing a liquid stain in contact with said absorbent means including a supply of liquid stain, tube means connecting the interior of said enclosed area with said supply of liquid stain, means for forcing the liquid stain through said tube means to said enclosed area, valve means operatively connected with said tube means for controlling the flow of liquid stain from said supply to said enclosed area; means for properly positioning a stockpiece between said metal rule die member and the other movable member of said press means in relation to said metal rule; means for controlling the depth of cut of said sharp edge of the metal rule into a stock-piece to a desired depth when embossing, one of the two members of said press means being a cylinder, said metal rule die member being cylindrical and being mounted on said cylinder, said means for positioning a stockpiece comprising a sliding means for sliding a stockpiece between one member of the press means and the cylindrical metal rule die member, said means for controlling the cut of said sharp edge of the metal rule into a stockpiece to a desired depth for embossing including two downwardly extending movable arms on which said cylinder member is mounted.

2. An apparatus as set forth in claim 1 wherein said sliding means has means thereon to accurately position the stockpiece to properly locate the design on a stockpiece.

3. An apparatus for embossing and staining a stockpiece comprising press means; said press means having two members movable relative to each other for providing a pressing action; a metal rule die member located between said members and being positioned on one of said members; said metal rule die member having a metal rule extending therefrom towards the other of said members and forming a desired design with an enclosed area therein; said metal rule having an edge which is sharp for embossing a stockpiece; absorbent means for receiving a stain being located in the enclosed area of said metal rule; said absorbent means having an exposed surface recessed from the sharp edge of the metal rule into said enclosed area; means for placing a liquid stain in contact with said absorbent means including a supply of liquid stain, tube means connecting the interior of said enclosed area with said supply of liquid stain, means for forcing the liquid stain through said tube means to said enclosed area, valve means operatively connected with said tube means for controlling the flow of liquid stain from said supply to said enclosed area; means for properly positioning a stockpiece between said metal rule die member and the other movable member of said press means in relation to said metal rule; means for controlling the depth of cut of said sharp edge of the metal rule into a stockpiece to a desired depth when embossing, said valve means being normally closed, valve operating means being actuated by said press means to open said valve means when a flow of liquid stain to said enclosed area is desired, said valve operating means being actuated by said press means to open said valve means after the depth of cut equals the distance that the absorbent means is recessed from the sharp edge of the metal rule.

4. An apparatus for embossing and staining a stockpiece comprising press means; said press means having two members movable relative to each other for providing a pressing action; a metal rule die member located between said members and being positioned on one of said members; said metal rule die member having a metal rule extending therefrom towards the other of said members and forming a desired design with an enclosed area therein; said metal rule having an edge which is sharp for embossing a stockpiece; absorbent means for receiving a stain being located in the enclosed area of said metal rule; said absorbent means having an exposed surface recessed from the sharp edge of the metal rule into said enclosed area; means for placing a liquid stain in contact with said absorbent means including a supply of liquid stain, tube means connecting the interior of said enclosed area with said supply of liquid stain, means for forcing the liquid stain through said tube means to said enclosed area, valve means operatively connected with said tube means for controlling the flow of liquid stain from said supply to said enclosed area; means for properly positioning a stockpiece between said metal rule die member and the other movable member of said press means in relation to said metal rule; means for controlling the depth of cut of said sharp edge of the metal rule into a stockpiece to a desired depth when embossing, said absorbent means being recessed approximately one-sixteenth of an inch from the sharp edge of the metal rule, the desired depth of cut of said sharp edge of the metal rule into a wood stockpiece being over approximately one-sixteenth on an inch.

* * * * *